United States Patent [19]

Bollen

[11] 4,164,720

[45] Aug. 14, 1979

[54] MERCURY-WETTED REED CONTACT RELAY

[75] Inventor: Romain F. Bollen, Hasselt, Belgium

[73] Assignee: C. P. Clare International N.V., Tongeren, Belgium

[21] Appl. No.: 901,157

[22] Filed: Apr. 28, 1978

[30] Foreign Application Priority Data

Apr. 29, 1977 [BE] Belgium ..... 177141

[51] Int. Cl.[2] ..... H01H 29/00

[52] U.S. Cl. ..... 335/47; 335/58

[58] Field of Search ..... 335/47, 49, 51, 55, 335/57, 58; 200/234

[56] References Cited

U.S. PATENT DOCUMENTS

| | | | |
|---|---|---|---|
| 3,356,813 | 12/1967 | Shinohara et al. | 335/58 X |
| 3,497,840 | 2/1970 | Strauder | 335/57 X |
| 4,047,135 | 9/1977 | Stuckert | 335/58 |

*Primary Examiner*—George Harris

*Attorney, Agent, or Firm*—Sughrue, Rothwell, Mion, Zinn, and Macpeak

[57] ABSTRACT

A reed contact relay comprising within a capsule, reeds the coacting tips of which are provided with spots made of a material which can not be wetted with mercury. Two tubes in magnetic material are aligned in spaced apart relation around the reeds such that an axial gap is formed therebetween at the lenghtwise level of the coacting tips of the reeds. The inner wall of these tubes and the surface of the reeds, except the surface of the spots, are wetted with mercury.

3 Claims, 2 Drawing Figures

MERCURY-WETTED REED CONTACT RELAY

FIELD OF THE INVENTION

This invention relates to an electromagnetic relay with mercury-wetted reed contacts which is capable of working in all positions with a high switching capability and a high sensitivity.

A mercury-wetted reed switch comprises two metal reeds enclosed in a glass capsule and which are wetted with mercury such that the latter is the effective contact material. In the known mercury wetted reed switches the mercury is contained in a small tank and consequently they have to be kept in a vertical position.

SUMMARY OF THE INVENTION

This invention has for its object to provide an improved mercury-wetted reed switch which can be used when in any position.

According to this invention, two tube means of magnetic material are placed within the glass capsule such as to be extending lengthwise around the reed means, said tube means being aligned in spaced apart relation such that an axial gap is formed therebetween being situated at the lengthwise level of the coacting ends of the reed means. The inner wall of these tube means and the surface of the reed means are wetted with mercury. The tips of these reed means however are provided with spots made of a material which can not be wetted with mercury.

DESCRIPTION OF AN EMBODIMENT

Figure 1:
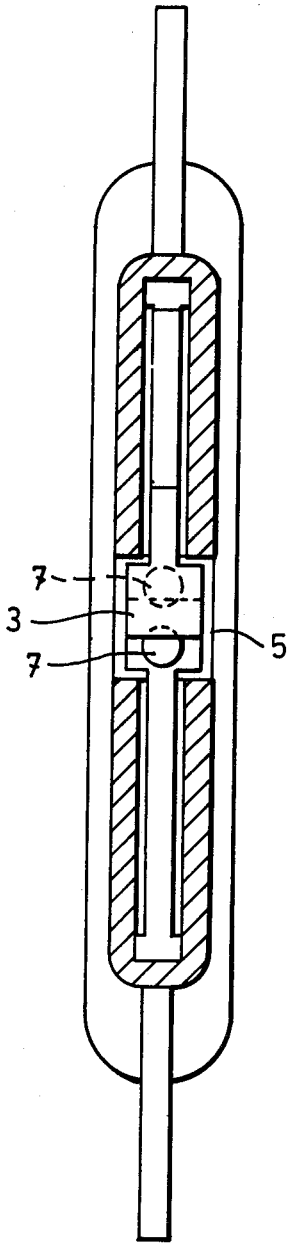
FIGS. 1 and 2 are two lengthwise sectional views of a reed contact relay according to the invention.
Figure 2:
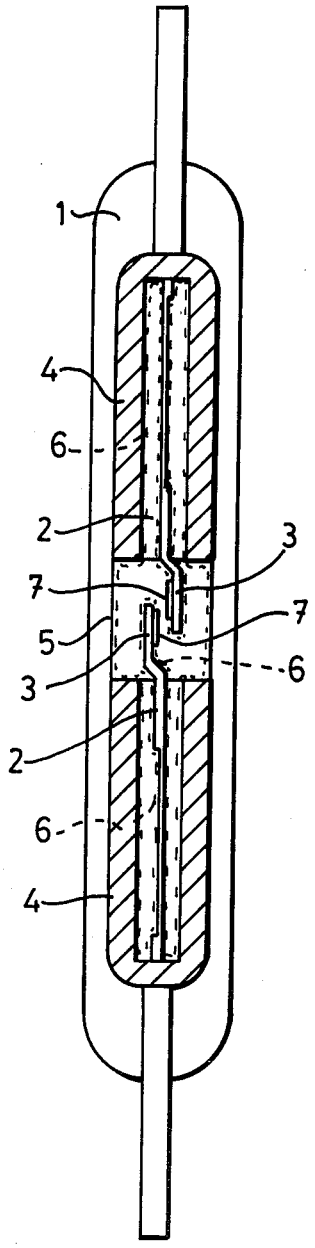

Referring to the drawings, there is shown a sealed glass capsule at 1 and two reeds contained therein at 2. The reeds are made of a magnetic material, e.g. Fe-Ni. In the capsule 1 are two tubes 4 which are spaced apart such that a gap 5 is formed therebetween surrounding the contact tips 3 of the reeds 2. The inner wall of the tubes 4 and the surface of the reeds 2 are wetted with mercury 6.

The tips 3 of the reeds 2 are provided with spots 7 made of a material which can not be wetted with mercury, e.g. chromoxide. These spots 7 must have an area which is sufficiently small such that, when the reed contacts are being switched, splashing mercury from the contact zone is quickly enough replaced otherwise the working of the relay at high switching frequencies would be made difficult.

The tips 3 of the reeds 2 are made sufficiently wide such that a too great mercury drop which would be projected against the wall of the glass capsule in the gap 5 between the tubes 4 can be sucked up by the reeds.

The axial spacing between the tubes 4 must be relatively small in order to prevent accumulation of mercury there. This axial width of gap 5 between the tubes 4 must be chosen in order to optimize the performance of the relay. When this gap is too wide, too much mercury can accumulate there which has the effect of drying the reeds 2 and consequently would cause the switching capability of the relay to decrease. When this gap is sufficiently short, there is assured that a small quantity of mercury is kept there, whereby the mercury circulation is still high. However, when the gap is too short, there is a chance that mercury causes short circuits to occur.

The tubes 4 are made of a magnetic material. They form magnetic shunts and have a geometric shape such that a flux concentration is produced in the zone containing the contacts, thereby to produce an optimum utilization of the magnetic field.

By using a soft magnetic material for the reeds 2 with a minimum remanence, e.g. Fe-Ni 50—50% of Fe-Ni 22–78% there is provided a normal monostable make contact relay.

By using a semi-hard magnetic material for the reeds with determined remanence and coercitive force there is provided a bistable latching relay, that is a relay which operates when energized by a magnetic field and is held operated when said magnetic field disappears. Such a latching relay opens its contacts when energized by a magnetic field in opposite direction.

The invention permits a latching relay to be realized with a minimum volume of semi-hard magnetic material, which is made possible due to several reasons:

(1) when the relay is operated, the airgap is very small due to the absence of non-magnetic contacts by contrast with the known mercury contact relays; said small airgap and the tubes made of soft magnetic material produce a small reluctance effective to produce a high effective magnetic flux in the airgap;

(2) the spring force of the reeds can be substantially smaller than that of dry reed relays.

Another advantage of this invention is that it permits conventional glass-metal connections to be used.

What is claimed is:

1. A mercury-wetted reed contact relay comprising at least two reed means having coacting ends contained in a glass capsule; two tube means made of magnetic material, said tube means extending lengthwise within the capsule and around the reed means said tube means being aligned in spaced apart relation such that an axial gap is formed therebetween being situated at the lengthwise level of the coacting ends of said reed means, the inner wall of said tubes and the surface of the reed means being wetted with mercury, and the tips of said reed means being provided with spots made of a material which can not be wetted with mercury.

2. A mercury-wetted reed contact relay according to claim 1, wherein the reed means are made of soft magnetic material.

3. A mercury wetted reed contact relay according to claim 1, wherein the reed means are made of a semihard magnetic material.

* * * * *